United States Patent [19]

Kuist et al.

[11] 4,065,197

[45] Dec. 27, 1977

[54] ISOLATED PATHS CONNECTOR

[75] Inventors: Charles H. Kuist, Mendham, N.J.; Vincent Squitieri, Billerica; Richard E. Seeger, Topsfield, both of Mass.

[73] Assignee: Chomerics, Inc., Woburn, Mass.

[21] Appl. No.: 479,668

[22] Filed: June 17, 1974

[51] Int. Cl.[2] ..... H01R 13/48

[52] U.S. Cl. ..... 339/17 M; 339/59 M; 339/DIG. 3

[58] Field of Search ..... 339/17 R, 17 C, 17 E, 339/17 L, 17 M, 17 LM, DIG. 3, 61 M, 59; 338/99, 100, 110, 114, 214

[56] References Cited

U.S. PATENT DOCUMENTS

| | | | |
|---|---|---|---|
| 3,648,002 | 3/1972 | DuRocher | 339/DIG. 3 |
| 3,680,037 | 4/1972 | Nellis et al. | 339/17 R |
| 3,883,213 | 5/1975 | Glaister | 339/61 M |

*Primary Examiner*—Joseph H. McGlynn
*Attorney, Agent, or Firm*—Sewall P. Bronstein

[57] ABSTRACT

An electrical connector in sheet form or the like which has a low through resistance in a volume between opposing surface contacts on opposite sides or surfaces of the sheet and provides a substantially higher isolation resistance in all volumes thereof between a contact on the surface of the sheet which is at a distance greater than the thickness of the sheet from any of the first of the above mentioned contacts.

2 Claims, 9 Drawing Figures

ISOLATED PATHS CONNECTOR

BACKGROUND OF THE DISCLOSURE

This invention is directed to a new and improved sheet connector or the like useful for coupling contacts of a first electrical device to the contacts of a second electrical device.

It is still conventional practice to couple contacts of one device to the contacts of a second device by soldering wires to the contacts. More recently other schemes have been proposed such as a plurality of electrically conductive plastic or rubber pads supported by an insulator, e.g., along slots on the sides thereof or in holes formed therein. In this case the contacts of the devices to be connected are positioned on opposite ends of the pads and the assembly is then held together in a conventional manner.

While the aforementioned schemes are quite useful they are expensive due to the costs associated therewith. Obviously soldering is time consuming and thus labor costs are high. In the second scheme manufacturing costs are high because of the steps needed to construct the insulator support and to then fill the slots or holes thereof in a molding process.

Accordingly a new and improved connector was needed which would be comparatively inexpensive in terms of materials used as well as in the cost of manufacture.

The present invention provides a connector which is both simple and inexpensive to manufacture and extremely simple to use in order to couple contacts of one electrical device to contacts of a second electrical device.

The connector of the present invention can be termed an isolated path connector in that is exhibits a low through resistance in a volume between aligned opposing surface contact of electrical contacts on opposite sides of the sheet and exhibits a higher isolation resistance in all volumes thereof at a distance greater than about the thickness of the sheet. Thus electrical contacts positioned apart from each other on the same side of the sheet at a distance greater than the thickness of the sheet are electrically isolated from each other even though another contact on the opposite side of the sheet and aligned with respect to one of the first of said contacts will be electrically coupled together.

In view of the above mentioned properties of the connector of this invention it is now possible to make electrical contact between a plurality of aligned contacts of first and second electrical devices by merely placing the sheet connector of this invention between the contacts so that surface contact is made between the contacts and the sheet. In this invention surface contact or touching need only be made to the sheet and compression of the volume of the sheet between opposing contacts is not necessary to achieve conduction, e.g. electrical contacts need only be screened on the sheet to effect contacting.

BRIEF DESCRIPTION OF THE DISCLOSURE

The connector of the invention in its preferred form comprises a layer or sheet of material comprising a binder and electrically conductive particles. Upon application of contacts to surface points on opposite sides of said material, the resistance through volume between the points is so low, e.g., less than 1,000 ohm, preferably less than 100–200 ohms, and most preferably less than 1 ohm, as to be useful for electrically coupling the points on opposite sides of said sheet to each other.

In addition, if added contacts are also applied as above to the same material at second points closely adjacent the first mentioned points, e.g., at a thickness greater than the thickness of the sheet (e.g., 5 times the thickness of the sheet) the resistance between the first mentioned and second mentioned points remains high, greater than $10^5$ ohm, preferably greater than $10^7$ ohms, and most preferably greater than $10^9$ ohms such that the first and second mentioned points are in effect electrically isolated from each other.

The thickness of the layer or sheet of material is preferably between 1 mil to 100 mils with a thickness of 2 to 40 mils being preferred and a thickness of 10 to 30 mils being most preferred. If the material becomes too thick, the material is no longer economic. If the material becomes too thin, then the material is hard to handle since it does not have sufficient physical strength.

The present invention discloses the use of electrical conductive powder or particles to produce the above mentioned electrical contacting and isolating effect.

As used herein the term electrically conductive powder or particles is intended to include metal powders as well as metal coated or covered particles such as glass or ceramic or other insulator material cores covered or coated with a layer of metal, or other electrically conductive particles such as titanium carbide.

The metals most desired for this invention includes the noble metals such as silver and gold or other metals such as copper and nickel or any combination thereof such as silver coated copper.

In terms of volume percent the conductive powder or particles contained in the sheet of material should be less than 20 volume percent to about 0.05 volume percent with 9 to 18 volume percent being preferred where metal particles are used and 0.05 to 0.11 volume percent being preferred where metal is covering an insulator core. As used herein the term volume percent means volume of the sheet when considering only the binder and the electrically conductive portion of the power or particles, e.g., the metal coating the glass on the metal itself.

When coated particles are used the insulator core is to be added to the binder for the volume percent determination of the metal content. For example, if the sheet contains binder equal to 70 volume percent, and silver coated glass cores are used, wherein the amount of silver in the sheet is 0.09% volume percent and the core represents 29.91 volume percent of the total sheet, the amount of metal (silver) is obviously equal to 0.09% volume percent of the total sheet, e.g., the sum of the binder, the glass cores and the silver.

While various irregular shaped particles may be used, for the practice of this invention it is preferred that the particles be substantially spherical in shape.

In addition, the particle size in terms of its maximum dimension is preferably between 0.2 mils to 90 mils depending upon sheet thickness and it is particularly preferred that the particle size is less than the thickness of the layer or sheet of material so that the particles do not extend above or below the surfaces of the layer or sheet. it is preferred that the particles be of ted glass cores are used, wherein the amount of silver in the sheet is 0.09% volume percent and the core represents 29,91 volume percent of the total sheet, the amount of metal (silver) is obviously equal to 0.09% volume percent of the total sheet, e.g., the sum of the binder, the glass cores and the silver.

While various irregular shaped particles may be used, for the practice of this invention it is preferred that the particles be substantially spherical in shape.

In addition, the particle size in terms of its maximum dimension is preferably between 0.2 mils to 90 mils depending upon sheet thickness and it is particularly preferred that the particle size is less than the thickness of the layer or sheet of material so that the particles do not extend above or below the surfaces of the layer or sheet.

For example, with sheet thickness of 20 mils it is preferred that the particles be of a size of about 10 mils (about 250 microns). It is also highly desireable for the practice of this invention that the dispersity of particles size should be kept to a minimum with a variation of ± 20% or less being preferred.

The binder materials suitable for the practice of this invention include flexible insulator materials such as thermosetting plastics, thermoplastics and elastomers.

Examples of such materials include silicone rubber, ethylene propylene polymer, Buna-N (nitrile rubber), polyurethane rubber, styrene butadiene rubber, natural rubber, neoprene rubber, polyethylene, polypropylene, vinyl chloride, and acrylics, e.g., polyethylmethylacrylate.

For the practice of this invention the sheet is preferably between 1 to 100 mils in thickness and more preferably between 2 to 40 mils in thickness.

In addition, the present invention does not preclude the use of fillers, plasticizers, catalysts, accelerators, pigments, smoothing agents commonly utilized in conductive plastics or elastomers such as silica (useful for its mechanical binding properties) so long as these materials do not severely affect the desireable properties of the connector.

It should be understood that the connector of this invention need not be in sheet form and can take many other physical shapes, e.g., wedge shaped, step shaped or other molded form as long as it operates in the manner disclosed. For example, it may contain locating ridges, protrusions, etc., which make it particularly useful for a particular function. In addition it may vary in thickness over its length or other dimensions when desired.

DETAILED DESCRIPTION OF THE DISCLOSURE

Figure 1:
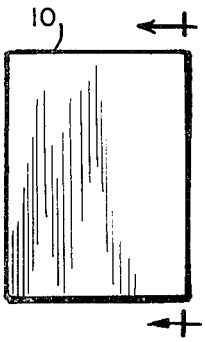
FIG. 1 is a top view of a connector sheet or layer according to the invention.
Figure 2:
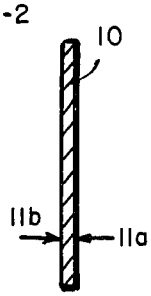
FIG. 2 is a sectional view taken along line 2—2 in FIG. 1.

FIGS. 1 and 2 illustrate a layer, film or sheet of the connector material 10 according to the invention and which in the configuration shown may be placed between aligned contacts of two electrical devices to effect electrical connection between aligned contacts while at the same time electrically isolating adjacent electrical contacts of the same device from each other.

The sheet of connector material is preferably of a thickness of 1 to 100 mils with a thickness of 10 to 30 mils being most preferred.

Thus with the connector sheet of this invention, ten to several hundred or more aligned contacts may be made for each square inch (i.e., 1 sq. inch) of the material surface (top and bottom surface) as long as the adjacent contacts are spaced apart from each other a distance greater than the thickness of the sheet, i.e., the distance between the top and bottom surfaces.

In the normal situation adjacent contacts of electrical devices used with this invention will be spaced apart about 1 to 5 times the thickness of the sheet and thus the connector sheet of this invention when providing electrical isolation at spacings equal to 1 to 5 times the thickness of the sheet is usable in a wide range of applications.

It is most preferable that to insure isolation in practice that the adjacent contacts be spaced at least about 1.25 to 1.5 times the thickness of the sheet.

The sheet of connector materials as stated before is preferably flexible so as to conform to the plurality of contacts of the electrical devices positioned upon it so as to insure good surface contact since quite often the electrical contacts of a device, e.g., circuit board, may be out of alignment, i.e., in more than one plane.

Figure 6:
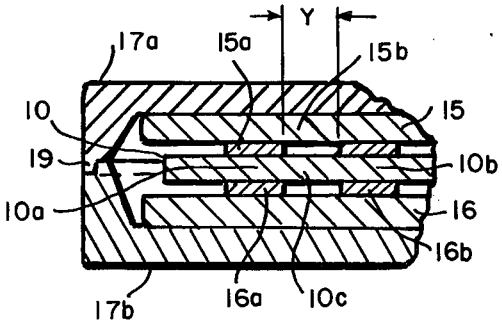
FIG. 6 is a sectional view taken at line 6—6 in FIG. 5 illustrating contacts being applied to the surface of the connector sheet.

The resistance between aligned contacts positioned on the opposite surfaces such as shown in FIG. 6, e.g., between contacts **15*a* and 16*a*** will depend for example upon the conductive particle loading, the thickness of the sheet, the dimensions and shape of the conductive particles and the exact binder.

In addition depending upon the ultimate use of the contacts, the contact resistance, i.e., between contacts **15*a* and 16*a*** can in practice be 1,000 ohms or less. For example, if a high input impedance device is being interconnected a resistance of 1,000 ohms per contact may be acceptable whereas in cases involving lower input impedance devices, contact resistance in the order of 100–200 ohms per contact or less such as 1 ohm or less of contact may be needed to effect optimum power transfer.

Accordingly in its preferred form the resistance through the sheet is preferably less than 1,000 ohms based on a measurement made with 25 mil square contacts e.g. copper contacts and is more preferably less than 200 ohms and most preferably 1 ohm or less.

The resistance between adjacent contacts e.g., **15*a* and 15*b* spaced a distance Y apart as shown in FIG. 6 and positioned in surface contact with the sheet is preferably at least $10^5$ ohms or greater with isolation resistances of $10^7$ to $10^{11}$ ohms or greater being preferred. Y in FIGS. 6 or 9** is a distance greater than the thickness X of the sheet.

In making the above isolation resistance and through contact resistance measurements, an ohmeter such as the Simpson 260 Series Ohmeter made by the Simpson Electrical Company of Chicago, Illinois may be used, using 25 mil square electrical contacting pads, e.g. of copper.

Figure 3:
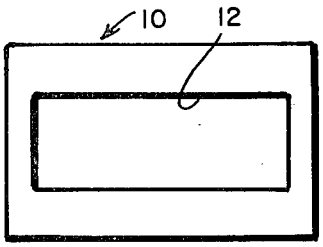
FIG. 3 is a top view of the connector layer or sheet having a portion cutout therein prior to placement into the structure shown in FIGS. 4–8.
Figure 4:
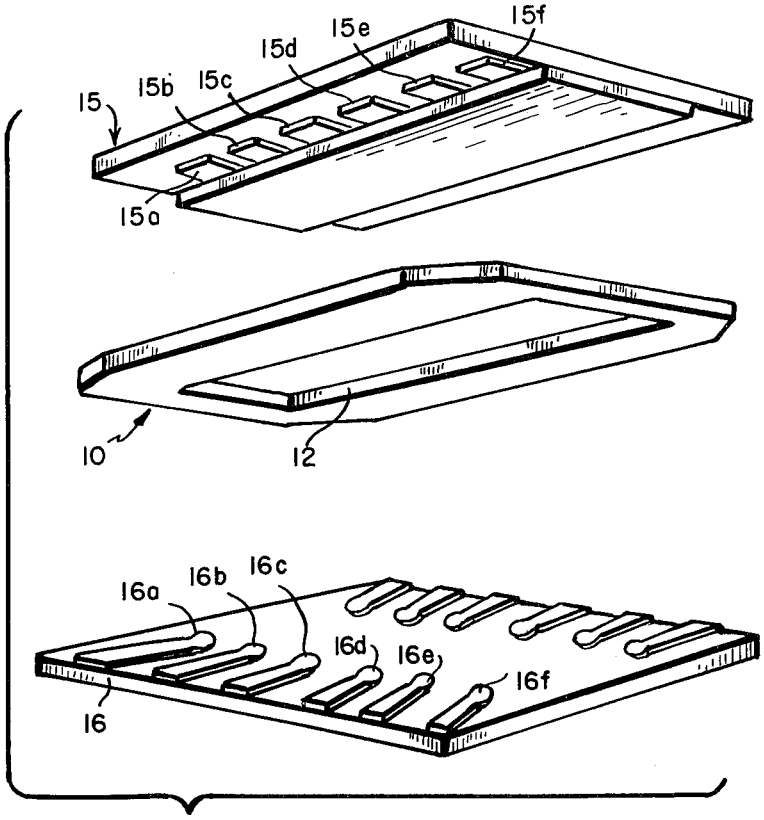
FIG. 4 illustrates the sheet of FIG. 4 positioned between first and second electrical devices such as a liquid crystal display and circuit board.
Figure 5:
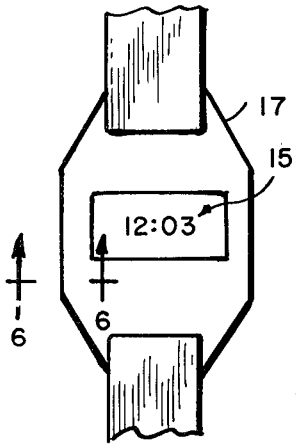
FIG. 5 illustrates a watch containing the connector as well as the other members shown in FIG. 4.

In FIG. 3 there is shown a cutout 12 in the sheet connector so that the connector 10 may be positioned as shown in FIGS. 4–6 in a watch or other electrical system to couple contacts 15*a* –15*f* of a first electrical device 15, e.g., a liquid crystal display to the contacts 16*a*–16*f* of a second electrical device 16 such as a circuit board supporting other circuitry not shown e.g., on the underside thereof.

The circuitry may comprise circuit patterns, passive devices, e.g., resistors, and active devices such as transistors to provide at contacts 16*a*–16*f*, etc., the signals to drive the liquid crystal package via contacts 15*a*–15*f*, etc.

It should be quite obvious to those skilled in the art that the present invention is not limited to the interconnection of the contacts of any specific or particular electrical devices and accordingly the invention herein should be construed to cover the interconnection of any types of electrical devices, e.g., circuit board to circuit board, integrated circuits to circuits, etc., in which the invention disclosed herein could be utilized by those skilled in the art. In addition the connector of this invention may be used as a circuit board substrate and be used to support a circuit which is to be interconnected to another circuit board, or other electrical device.

As may be seen in FIG. 6 the contacts 15*a* and 15*b* are shown aligned with contacts 16*a* and 16*b*. Surface contact is made to the connector sheet 10 by means of hold-down snap means 19 of the watch casing halves 17*a* and 17*b*.

The closure of the watch casing positions the aligned contacts, e.g., 15*a* and 16*a* into surface conforming contact with the connector sheet 10 thereby electrically coupling contacts 15*a* to 16*a*, 15*b* to 16*b* and so forth while electrically isolating contacts 15*a* from 15*b*, 16*b* from 16*a*, 15*a* from 16*b* and 15*b* which are at a laterial isolation distance Y apart from each other. It may be observed that electrical continuity occurs between aligned opposed contact pairs 15*a* and 16*a* while non-aligned opposed or diagonally opposed contacts 15*a* and 16*b* are electrically isolated by a high resistance.

Therefore when current flows between contacts 15*a* and 16*a* it will primarily flow in the connector material volume 10*a* and not be dissipated by slowing through different pathways to the non-aligned or isolated contacts 15*b* or 16*b*.

Figure 8:
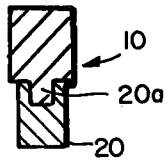
FIG. 8 is a sectional view taken along line 8—8 in FIG. 7.
Figure 7:
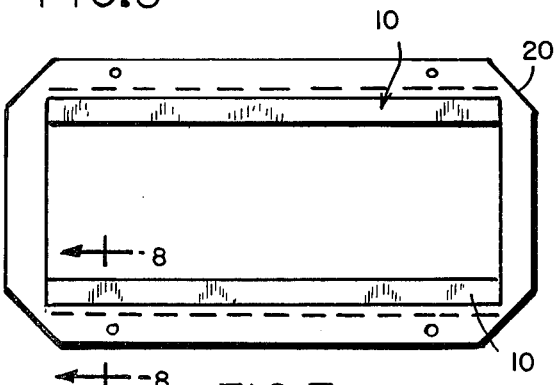
FIG. 7 is an alternate embodiment for supporting the connector sheet in a watch or other device.

In FIGS. 7 and 8 there is shown a plastic frame 20, e.g., of polyprophylene for holding the connector sheets 10 (in the form of strips) by way of a slot 20*a* formed in the frame. The frame 20 may then be placed between the electrical devices of FIG. 4 to perform the same function as the connector sheet having the cutout 12.

Figure 9:
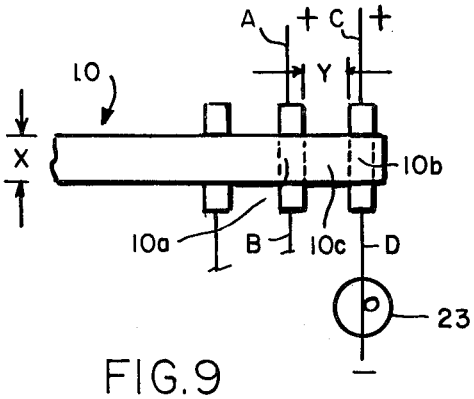
FIG. 9 illustrates schematically the physical properties of the connector of this disclosure.

FIG. 9 illustrates in schematic form the use of the connector of the invention. In this FIG. the connector is in the form of a sheet having a thickness X e.g., 20 mils and the contacts A,B,C,D etc., to be interconnected are shown on opposite sides of the sheet.

As may be seen contacts A and B are aligned at opposite sides of the sheet surface to engage a volume 10*a* therebetween and contacts C and D are also aligned at opposite sides of the sheet surface to engage another volume 10*b* of the sheet. The distance between contacts A and C, and B and D along the surfaces of the sheet is set at a distance Y, e.g., 30 mils apart although obviously this may vary.

Upon surface coupling of the contacts A or B, or C or D, to the sheet 10 (which may for example be a square contact having an area of 0.25 mils by 0.25 mils, the resistance between contacts A to D or A to C is $10^5$ to $10^{11}$ ohms greater than the resistance between contacts A to B and the distance between contacts A and B is 1,000 ohms or less and is greater than 0 ohms.

Thus the volume 10*c* between the contacts remains high in resistance so as to effectively electrically isolate the contacts D or C from contacts A or B. Upon the connection of contacts C and D between the + and − terminals of a source (e.g., a battery) an indicator light shown at 23 may be illuminated.

Obviously in place of an indicator light other electrical devices may be supplied with energy in a like manner.

Accordingly the present invention provides an isolated pathway connector or interconnector preferably in sheet form and which comprises a flexible insulator binder having electrically conductive particles dispersed therethrough, said connector characterized in that it exhibits a resistance of less than 1,000 ohms between aligned electrical contacts positioned on opposite sides (top and bottom surfaces) of the sheet and making surface contact therewith and a resistance greater than $10^5$ ohms between diagonally opposed contacts as well as contacts adjacent to each other on the same surface of the sheet (top or bottom) at an isolation distance apart equal to 5 times the thickness of the sheet.

As used herein the term surface contact means that the electrical contact comes into good electrical conforming contact with the surface of the sheet necessarily compressing the volume of the sheet opposite contacts to achieve low through resistance of the sheet volume between contacts. For example the electrical contacts need only be glued to the surface or applied e.g., by screening thereto as an electrically conductive ink.

The following examples illustrate the connector of the invention. All ingredients in the examples unless otherwise specified are in terms of volume percent.

EXAMPLE I

A connector sheet is prepared from:

Dow Corning 440 Silicone Gum Rubber — 79.83 vol. %

Cabosil MS 7 fumed Silica — 3.55 vol. %

Chemalloy U.B. 20/325 grade — 15.70 vol. %

Nickel Powder (screened through 60 mesh, caught on 100 mesh)—Chemalloy Co. Bryn Mawr, Pa.

Varox Peroxide catalyst (50% active) — 0.92 vol. %

The rubber gum is banded together at room temperature on a rubber roll mill until a small bank is produced between the mill rolls. At this time the Varox is added to the Silicone Gum before it proceeds through the rolls to force the Varox into the gum. In the same manner the silica is added first and then the nickel is added. The gum with the added materials is periodically cut as it comes out of the rolls and is refed through the rolls until a homogeneous mixture is obtained. Fifteen passes have been found to be sufficient.

The rolls of the mill are spaced apart to provide a sheet of about 25 mil thickness. The sheet is then placed in a compression mold at 4,000 psi pressure for 20 minutes at 325° F to cure to provide a 20 mil sheet. The sheet is then post baked for 3 hours at 400° F to complete the cure.

The sheet thus obtained has a thickness of about 20 mils. Using 25 mil square contacts positioned as are contacts 15*a* and 16*a* in FIG. 6. The resistance through the sheet was about 0.1 ohms when spaced along the surface of the sheet 25 mils apart (as with contacts 15*a* and 16*b* in FIG. 6) is greater than $10^7$ ohms.

EXAMPLE II

The procedure of EXAMPLE I was followed except that Nickel Powder was screened through 100 mesh and caught on 325 mesh.

The sheet prepared was 20 mils thick. With the contacts as in EXAMPLE I, spaced as in EXAMPLE I, the through resistance between aligned opposed contacts was 2.2 ohms and the isolation resistance between adjacent contacts on the same side of the surface spaced apart 25 mils or similarly diagonally spaced was greater than $10^7$ ohms.

EXAMPLE III

The procedure of EXAMPLE I was followed except that the following ingredients were used to form a 10 mils thick sheet under compression after sheeting to 15 mils.

Dow Corning 440 Silicone Gum Rubber - 80.03 vol. %
Cabosil MS 7 fumed Silica — 3.56 vol. %
Varox Peroxide catalyst (50% active) — 0.92 vol. %
Silver Plated Copper Powder as in U.S. Pat. No. 3,202,488 (7.66 vol. % AG) screened through 200 mesh — 15.49 vol. %

Using aligned 25 mil square contacts the resistance through the sheet was 0.7 ohms and when diagonally spaced apart 25 mills the isolation resistance was greater than $10^7$ ohms.

EXAMPLE IV

Using the mixing procedure of EXAMPLE I, except that the rolls are heated to between 270° F to 300° F a 15 mil thick sheet connector was prepared in a compression mold at 4,000 psi for 3 minutes at 250° F and then cooling same to 130° F after sheeting to 20 mils with the following ingredients:

Alathon 14 low density
Polyethylene (Dupont) — 47.98 vol. %
Vistanex L 80 polyisobutylene Enjay Chemical Co. — 32.32 vol. %
Chemalloy Nickel of EXAMPLE I — 19.70 vol. %

The through resistance between contacts for the sheet was 0.2 ohms and the isolation diagonal contact resistance was greater than $10^7$ ohms.

EXAMPLE V

Following the procedure of EXAMPLE I a 20 mil thick sheet connector was prepared with the following ingredients:

Dow Corning 440 Silicone Gum Rubber — 71.27 vol. %
Cabosil MS 7 fumed Silica — 3.17 vol. %
Verox Peroxide catalyst (50% active) — 0.82 vol. %
Silver Plated Glass Powder No. 24295 — 24.65 vol. % glass (Potters Brothers, Carlstadt, New Jersey) — 0.09 vol. % Ag The through resistance between contacts was 0.3 ohms and the diagonal isolation resistance between contacts 15*a* and 16*b* was greater than $10^7$ ohms.

EXAMPLE VI

The EXAMPLE I procedure and ingredients was followed except that the volume percent of Nickel used was 18.74%.

The through resistance of the 20 mil thickness homogeneous sheet connector was 0.05 ohms and the isolation diagonal and isolation adjacent contact resistance at 25 mil spacing was greater than $10^7$ ohms.

EXAMPLE VII

The EXAMPLE V procedure and ingredients were followed except that the volume percent of the glass was 14.69% and the volume percent of Silver was 0.05%.

The through resistance between contacts was 8.5 ohms and the isolation diagonal resistance at 25 mil spacing was greater than $10^7$ ohms for the 20 mil thickness sheet.

We claim:

1. An electrical one piece connector in the form of a sheet having a thickness of between 1 to 100 mils and having top and bottom surfaces and which comprises a homogeneous mixture of a flexible insulator material binder and metal particles, said connector having means for providing at least when uncompressed a low through resistance of less than 1,000 ohms between opposite aligned points on said top and bottom surfaces as well as a high isolation resistance, which is greater than 100,000 ohms, along the top and bottom surfaces between points at a distance apart equal to five times the thickness of the connector between said top and bottom surfaces further characterized in that the connector exhibits said low through resistance through the volume between aligned opposed electrical contacts placed on opposite top and bottom surfaces thereof merely in surface contact therewith and said high isolation resistance between diagonal electrical contacts placed on opposite top and bottom surfaces thereof as well as between adjacent electrical contacts placed on the same surface thereof all merely in surface contact therewith at a distance apart equal to five times the thickness of the connector between said top and bottom surfaces, and in which the connector contain 9 to 18 volume percent of metal particles.

2. An electrical one piece connector in the form of a sheet having a thickness between 1 to 100 mils and having top and bottom surfaces and which comprises a homogeneous mixture of a flexible insulator material binder, which is a thermosetting plastic, thermoplastic or an elastomer, and electrically conductive particles, said connector having means for providing at least when uncompressed a low through resistance of less than 1,000 ohms between opposite aligned points on said top and bottom surfaces as well as a high isolation resistance, which is greater than 100,000 ohms, along the top and bottom surfaces between points at a distance apart equal to five times the thickness of the connector between said top and bottom surfaces further characterized in that the connector exhibits said low through resistance through the volume between aligned opposed electrical contacts placed on opposite top and bottom surfaces thereof merely in surface contact therewith and said high isolation resistance between diagonal electrical contacts placed on opposite top and bottom surfaces thereof as well as between adjacent electrical contacts placed on the same surface thereof all merely in surface contact therewith at a distance apart equal to five times the thickness of the connector between said top and bottom surfaces, and in which the connector contains less than 20 volume percent of electrically conductive particles.

* * * * *

UNITED STATES PATENT AND TRADEMARK OFFICE

CERTIFICATE OF CORRECTION

PATENT NO. : 4,065,197

DATED : Dec. 27, 1977

INVENTOR(S) : Charles H. Kuist, Vincent Squitieri and R.E. Seeger

It is certified that error appears in the above-identified patent and that said Letters Patent are hereby corrected as shown below:

Column 2, line 5, "e.g." should read -- i.e. --

Column 2, line 42, "power" should read -- powder --

Column 2, line 53, "e.g." should read -- i.e. --

Column 2, line 64, after "sheet." delete the remainding lines through column 3, line 12.

Column 3, line 15, "desireable" should read -- desirable --

Column 3, line 36, "desireable" should read -- desirable --

Column 5, line 29, after "another" insert -- circuit or a --

Column 5, line 40, after "16b and" insert -- 16a

UNITED STATES PATENT AND TRADEMARK OFFICE

CERTIFICATE OF CORRECTION

PATENT NO. : 4,065,197

DATED : DEC. 27, 1977

INVENTOR(S) : C.H. KUIST, VINCENT SQUITIERI and RICHARD E. SEEGER

It is certified that error appears in the above-identified patent and that said Letters Patent are hereby corrected as shown below:

from --

Column 5, line 40, "laterial" should read -- lateral-

Column 5, line 52, "polyprophylene" should read -- polypropylene --

Column 6, line 5, after "contact" insert -- ) --.

Column 6, line 35, after "sheet" insert -- without --

Column 6, line 36, after "sheet" insert -- between --

Column 7, line 36, "mills" should read -- mils --

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*